US006834631B1

(12) United States Patent
Blackburn et al.

(10) Patent No.: US 6,834,631 B1
(45) Date of Patent: Dec. 28, 2004

(54) METHOD OF DETERMINING TRANSITION FROM STARTER TO ALTERNATOR FUNCTION BY MONITORING BELT TENSION OR TENSIONER POSITION

(75) Inventors: Scott Evart Blackburn, Temperance, MI (US); Eric Keith Manning, Toledo, OH (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 10/793,768

(22) Filed: Mar. 8, 2004

(51) Int. Cl.[7] ..... F02N 17/00
(52) U.S. Cl. ..... 123/179.3; 474/135
(58) Field of Search ..... 123/179.3; 474/135–138

(56) References Cited

U.S. PATENT DOCUMENTS 4,758,208 A 7/1988 Bartos et al. ..... 474/135
4,826,467 A 5/1989 Reese et al. ..... 474/14
6,506,137 B2 * 1/2003 Guhr ..... 474/135
6,725,821 B2 * 4/2004 Warren et al. ..... 123/179.3
2003/0153420 A1 * 8/2003 Rogers ..... 474/134
2003/0171179 A1 * 9/2003 Okuda et al. ..... 474/110
2003/0220164 A1 * 11/2003 Tamai ..... 474/134
2004/0077446 A1 * 4/2004 Manning ..... 474/134
2004/0087401 A1 * 5/2004 Serkh ..... 474/134
2004/0097309 A1 * 5/2004 Kirstein ..... 474/101

* cited by examiner

*Primary Examiner*—Mahmoud Gimie
*Assistant Examiner*—Arnold Castro
(74) *Attorney, Agent, or Firm*—Liniak, Berenato & White

(57) ABSTRACT

The present invention is directed to determining and controlling the appropriate moment at which a combined starter/alternator should transition from start-up mode to alternator/generator mode following an IC engine start-up sequence. The method relies on either belt/chain tensioner position or the position of the belt/chain itself to determine when the IC engine has achieved self-sustaining operation and signal the starter/alternator to transition from start-up to generator mode.

4 Claims, 5 Drawing Sheets

Start Cycle
Engine Not Started - Engine Cranking

Engine Self-Sustained Operation

Start Cycle
Engine Not Started - Engine Cranking

Engine Self-Sustained Operation

METHOD OF DETERMINING TRANSITION FROM STARTER TO ALTERNATOR FUNCTION BY MONITORING BELT TENSION OR TENSIONER POSITION

FIELD OF THE INVENTION

The invention relates to the field of automotive electrical systems. Specifically, the invention is directed to a method of determining the moment following a start-up sequence for an IC engine as to when a starter/alternator should transition from start-up to generator function.

BACKGROUND OF THE INVENTION

The trend in automotive electrical systems has always been towards more power and higher voltages. At this time, an element of the trend involves the combination of the alternator and starter into a single IC engine driven unit. This combined starter/alternator can be driven either directly on the crankshaft of the IC engine as a part of the flywheel, on one end, or the balancer, on the other. Alternatively, the starter/alternator can be mounted for gear, belt, or chain drive from the crankshaft along with other IC engine driven components (i.e., waterpump/A/C compressor/power steering pump, etc.)

The starter/alternator has become more powerful not only for increasing power (current and voltage) but also for more rapid and more fequent starting cycles of the IC engine as enhanced operating efficiencies are sought. In pursuit of these goals, the starter/alternator has become more sophisticated in its control systems and its responsiveness to system requirements for both starter functions and generating functions.

In older systems where the alternator and starter function were performed by separate devices, the need to determine the optimal moment to transition from a starter function to an alternator function did not exist. Rather, the vehicle operator, relying on vehicle familiarity and overall driving experience, actuated the starter until engine startup was perceived. To limit the possibility of damaging the starter from overspeed, a special one-way disengaging drive was sometimes employed.

The alternator or generator was connected into older systems by virtue of a regulator that either accepted charge into the system to meet an electrical load, or for battery charging, or kept the alternator out of the system altogether as necessary. The alternator or generator in older systems did not change function from a starter to an alternator or generator.

In more modern vehicles with combined starter/alternator devices, a need exists to transition the device from starter to alternator/generator function at an appropriate moment following IC engine start-up. If the transition occurs too quickly, the IC engine may not, in-fact, have started. If it occurs too slowly, damage to the starter/alternator device may occur either directly or to the driving/driven mechanical connection between the IC engine and the device. In either case, premature wear and/or replacement is the likely outcome.

SUMMARY OF THE INVENTION

The present invention is directed to determining and controlling the appropriate moment at which a belt or chain driven combined starter/alternator should transition from start-up mode to alternator/generator mode following an IC engine start-up sequence. The method relies on starter/alternator belt/chain tension or tensioner position to establish the timing of the transition.

In the tensioner position monitoring embodiment, the starter/alternator controller, or other monitoring controller, monitors the angular or linear position of the belt/chain tensioner for the drive belt/chain that includes the starter/alternator into the accessory drive system for the IC engine. The tensioner will rotate, or translate linearly, to a first position as the starter function is initiated and begins engine cranking. When the IC engine begins generating its own self-sustaining torque, the angular position, or linear position, of the tensioner will change accordingly in reaction to the change in drive being transferred to the IC engine. The starter/alternator controller will detect the change in position and then make the transition from starting mode to generation mode.

In the belt/chain tension monitoring embodiment, the belt/chain position is monitored for movement between a relatively slack and tensile condition. Following an initiation of IC engine cranking, the belt/chain position on the pull side of the starter/alternator pulley follows a straight line between the pulley tangent points of initial belt/chain contact. On the slack side of the starter/alternator pulley, the belt/chain is less straight and curves away from the line between the tangent points of contact at adjacent pulleys. When the IC engine begins to obtain self-sustaining operation, the slack side of the belt/chain is pulled straight as the IC engine accelerates. The monitoring controller will detect the change in belt/chain position and then signal the starter/alternator to make the transition from starting mode to generation mode.

DETAILED DESCRIPTION

Figure 1:
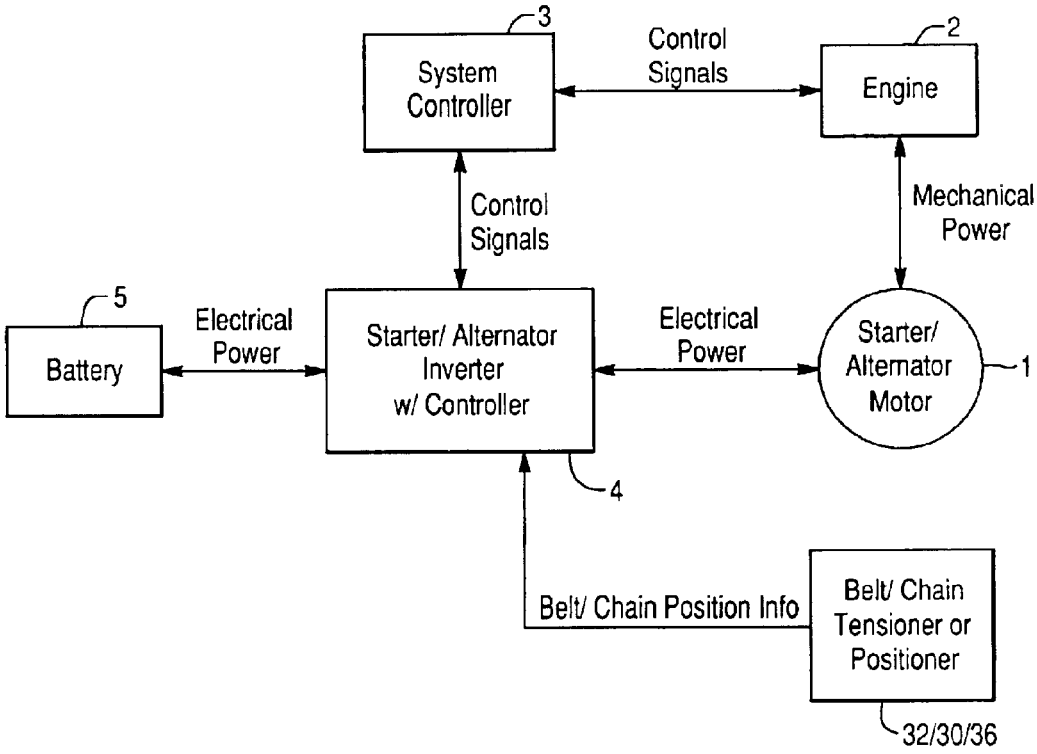
FIG. 1 is a block diagram of an IC engine, starter/alternator system for accomplishing the methods of the present invention.
Figure 2:
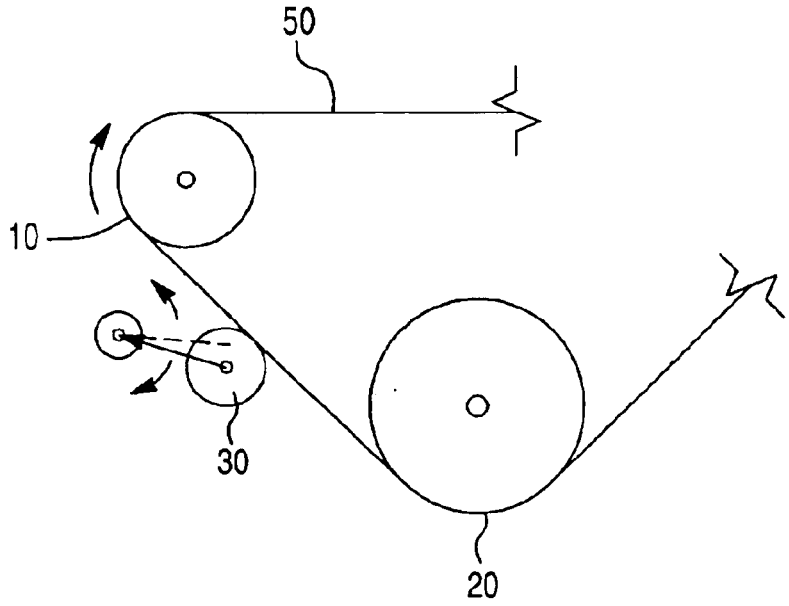
FIG. 2 is a schematic of a starter/alternator IC engine belt/chain pulley system incorporating a rotary type tensioner using the present method.
Figure 3:
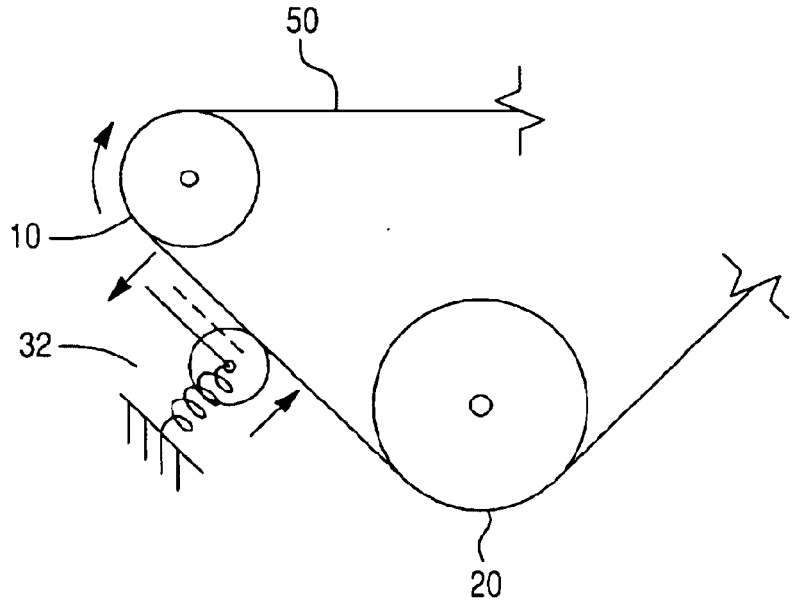
FIG. 3 is a schematic of a starter/alternator IC engine belt/chain pulley system incorporating a linear type tensioner using the present method.
Figure 4:
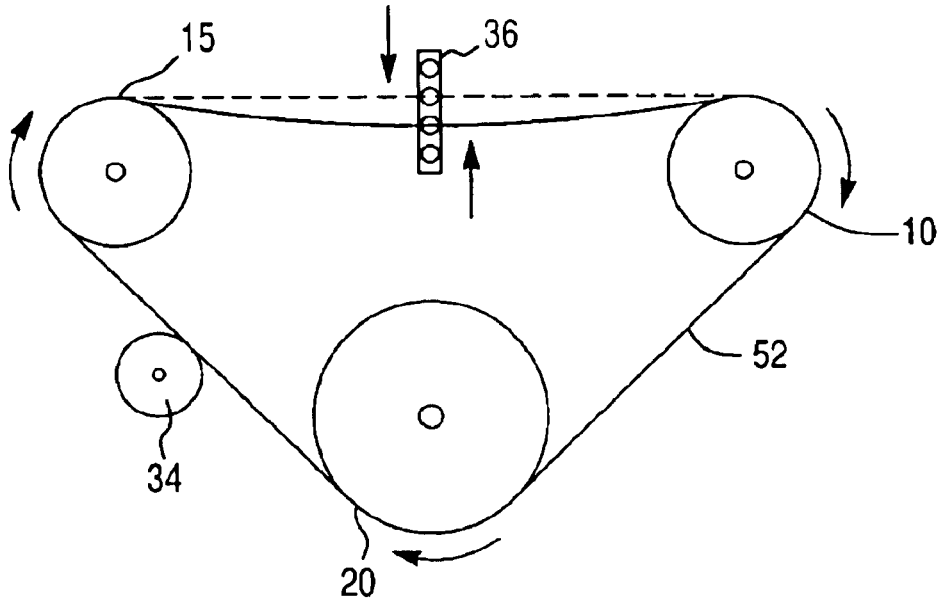
FIG. 4 is a schematic of a starter/alternator IC engine belt/chain pulley system incorporating a tension monitor using the present method.

The present invention is directed to a method of controlling a starter/alternator device and determining the appropriate moment to transition from starter function to alternator/generator function following a start-up sequence. The invention includes three embodiments. FIG. 1 is a block diagram of the component elements of an IC engine system that can accomplish the present method. FIG. 2 shows a schematic of a rotary tensioner embodiment of the present method, FIG. 3 shows a schematic for a linear tensioner embodiment system using the present method, and FIG. 4 shows a belt/chain tension monitor embodiment using the present method.

As shown in FIG. 1, the present method is intended to function in a system including an IC engine 2 and a belt or chain driven starter/alternator 1. The system further includes a system controller 3 that supplies control signals to the IC engine as well as to and from the starter/alternator controller 4. A battery 5 is also associated with the system and receives charging and loading as necessary by the controller 4.

Figure 5A:
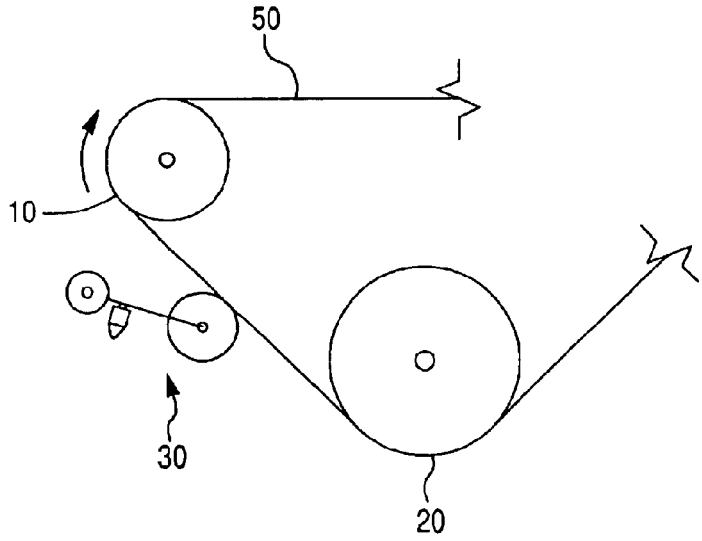
FIG. 5*a* shows an IC engine system using the present method, in combination with a fixed sensor apparatus, in an engine cranking mode.

FIG. 2 is a schematic showing a starter/alternator pulley 10 and engine pulley 20 with a rotary type tensioner 30 positioned between the respective pulleys and in contact with a belt/chain 50. A rotary type tensioner 30 herein is of the type where tension is maintained using a rotating translation of a lever or post mounted belt/chain contacting pulley or guide element. The tension can be maintained with a wound spring, hydraulic pressure, pneumatic pressure, etc., and the rotary position is monitored using a signal producing position sensor (either fixed as in FIG. 5*a*, or rotary/angular as in 6*a*) that provides position information to controller 4.

Figure 5B:
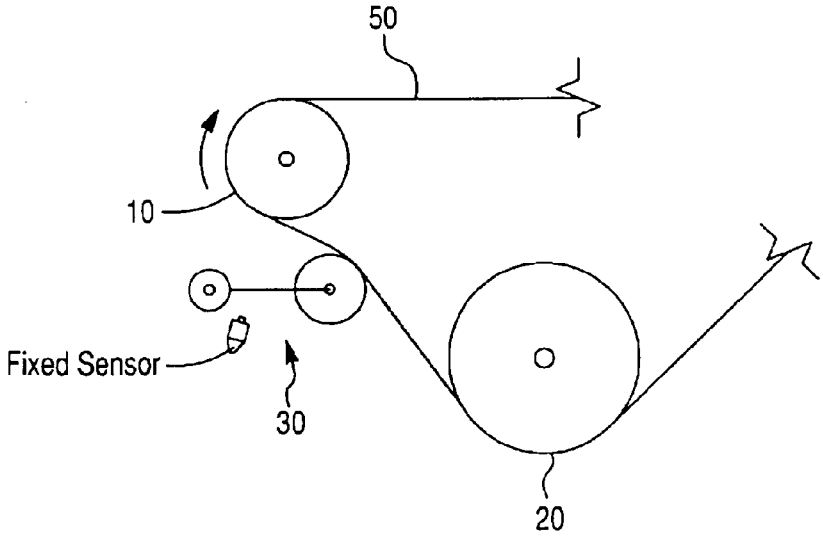
FIG. 5*b* shows the IC engine system of FIG. 5*a* wherein the engine has obtained self-sustained operation.
Figure 6A:
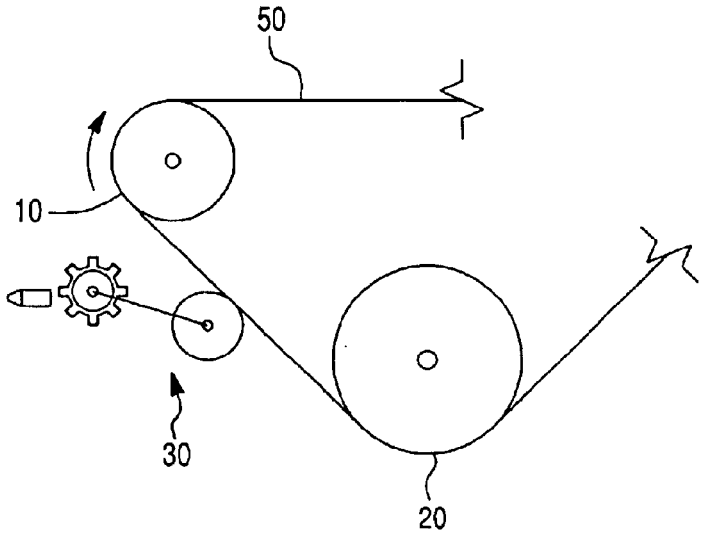
FIG. 6*a* shows an IC engine system using the present method, in combination with a rotary sensor apparatus, in an engine cranking mode.
Figure 6B:
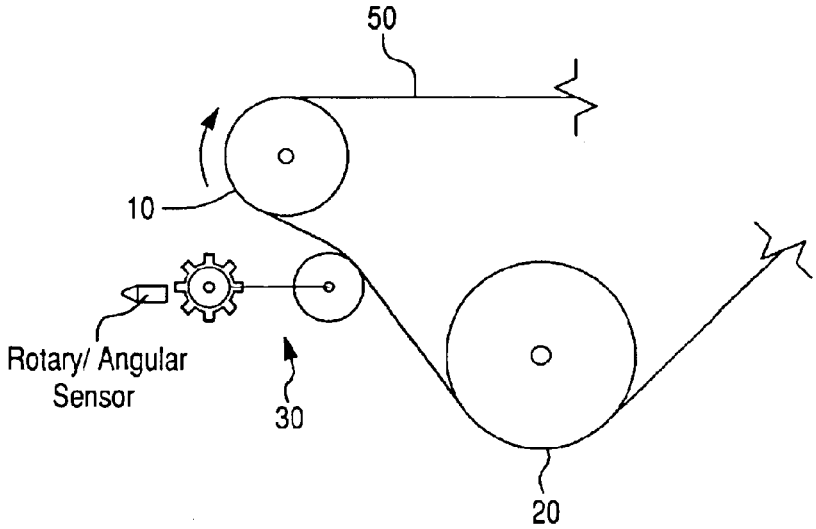
FIG. 6*b* shows the IC engine system of FIG. 6*a* wherein the engine has obtained self-sustained operation.

When a start cycle is initiated (see FIGS. 5*a*, 6*a*), the segment of belt/chain 50 between the starter/alternator pulley 10 and engine pulley 20 is pulled straight by virtue of the pull of the starter/alternator to rotate and crank the engine pulley 20. This reaction of the belt/chain 50 urges it against the tensioner 30 and causes a change in position. For as long as the starter/alternator is cranking the engine pulley 20, the tensioner 30 will maintain a steady position against the tension of the belt/chain 50 between the pulleys 20 and 10. As the IC engine begins self sustaining operation, the tension in the belt/chain 50 segment between the pulleys 10 and 20 will decrease owing to the increasing speed of the self sustained engine and the decreasing cranking requirement of the starter/alternator to crank the IC engine. The lessening tension in the belt/chain will cause a change in tensioner 30 position as shown in FIGS. 5*b* and 6*b*. The tensioner 30 position sensor will provide this information to the controller 4 and the controller will, in turn, transition the starter/alternator 1 from starter function to generator function.

FIG. 3 is a schematic showing a starter/alternator pulley 10 and engine pulley 20 with a linear type tensioner 32 positioned between the respective pulleys and in contact with a belt/chain 50. A linear type tensioner 32 herein is of the type where tension is maintained using a linear translation of a belt/chain contacting pulley or guide element. The tension can be maintained with a wound spring, hydraulic pressure, pneumatic pressure, etc., and the linear position is monitored using one or more signal producing position sensor(s) that provide position information to controller 4.

When a start cycle is initiated, the segment of belt/chain 50 between the starter/alternator pulley 10 and engine pulley 20 is pulled straight by virtue of the pull of the starter/alternator to rotate and crank the engine pulley 20. This reaction of the belt/chain 50 urges it against the tensioner 32 and causes a change in position. For as long as the starter/alternator is cranking the engine pulley 20, the tensioner 32 will maintain a steady position against the tension of the belt/chain 50 between the pulleys 20 and 10. As the IC engine begins self sustaining operation, the tension in the belt/chain 50 segment between the pulleys 10 and 20 will decrease owing to the increasing speed of the self sustained engine and the decreasing cranking requirement of the starter/alternator to crank the IC engine. The lessening tension in the belt/chain will cause a change in tensioner 32 position. The tensioner 32 position sensor will provide this information to the controller 4 and the controller will, in turn, transition the starter/alternator 1 from starter function to generator function.

FIG. 4 is a schematic showing a starter/alternator pulley 10 and engine pulleys 15, 20 with a rotary or linear type tensioner 34 positioned between the respective pulleys and in contact with a belt/chain 52. One or more belt/chain position sensor 36 (optical, electrical, etc.) are located along a pathway of the belt/chain 52 so that it can monitor the lateral position of belt/chain 52 as it passes between pulleys 10& 15, 15 & 20, or both.

When a start cycle is initiated, the segment of belt/chain 52 between the starter/alternator pulley 10 and engine pulley 20 is pulled straight by virtue of the pull of the starter/alternator to rotate and crank the engine pulley 20. The belt/chain 52 segment between other pulleys, i.e., between 10 and 15, will slacken. This slack reaction of the belt/chain 52 urges it away from a straight tangential path between adjacent pulleys 10, 15. For as long as the starter/alternator is cranking the engine pulley 20, the belt/chain 52 will maintain a relatively steady position between the pulleys 10, 15. As the IC engine begins self sustaining operation, the tension in the belt/chain 52 segment between the pulleys 10 and 15 will increase owing to the decreasing cranking requirement of the starter/alternator to crank the IC engine combined with the acceleration of the IC engine pulley 20. The belt/chain 52 will follow a straighter more tangential path between pulleys 10, 15. The position sensor 36 will provide this information to the controller 4 and the controller will, in turn, transition the starter/alternator 1 from starter function to generator function.

Sensors that are suitable for use with the tensioners 30, 32, 36 are any of available Hall effect, magnetic reed, optical, proximity radar, limit switch, potentiometer, etc., or their equivalent, that are robust and reliable enough for the harsh IC engine associated environment.

We claim:

1. A method of controlling a starter/alternator in a start-up sequence of an IC engine driven generating system including belt/chain driven starter/alternator, a belt/chain tensioner, and a starter/alternator controller, comprising the steps of:

initiating a start-up sequence of said IC engine by signaling said starter/alternator to operate in starter mode;

detecting a first position of a belt/chain tensioner;

detecting a second position of said belt/chain tensioner;

comparing said first and second detected belt/chain tensioner positions; and, signaling said starter/alternator to transition from start-up to alternator/generator mode when said second detected position is different from said first detected position.

2. A method as in claim 1, wherein:

said belt/chain tensioner is a rotary tensioner.

3. A method as in claim 1, wherein:

said belt/chain tensioner is a linear tensioner.

4. A method of controlling a starter/alternator in a start-up sequence of an IC engine driven generating system including a belt/chain driven starter/alternator, a belt/chain position sensor, and a starter/alternator controller, comprising the steps of:

initiating a start-up sequence of said IC engine by signaling said starter/alternator to operate in starter mode;

detecting a first position of a belt/chain;

detecting a second position of said belt/chain; comparing said first and second detected belt/chain positions; and, signaling said starter/alternator to transition from start-up to alternator/generator mode when said second detected position is different from said first detected position.

* * * * *